US006464465B2

(12) United States Patent
House

(10) Patent No.: US 6,464,465 B2
(45) Date of Patent: Oct. 15, 2002

(54) LEVEL CONTROL DEVICE FOR A WASTEWATER COLLECTION BASIN

(76) Inventor: Glenn P. House, 105 Riverwood Dr., Fort Mill, SC (US) 29715

( * ) Notice: Subject to any disclaimer, the term of this patent is extended or adjusted under 35 U.S.C. 154(b) by 0 days.

(21) Appl. No.: 09/783,348

(22) Filed: Feb. 14, 2001

(65) Prior Publication Data

US 2002/0114702 A1 Aug. 22, 2002

(51) Int. Cl.[7] ..... F04B 49/04

(52) U.S. Cl. ..... 417/40; 417/423.3; 73/305; 73/306; 73/307; 73/308; 73/309; 73/311

(58) Field of Search ..... 417/40, 423.3; 73/305, 306, 307, 308, 309, 311

(56) References Cited

U.S. PATENT DOCUMENTS

| | | | | | |
|---|---|---|---|---|---|
| 1,568,500 | A | * | 1/1926 | Conrader | 417/2 |
| 1,820,981 | A | * | 9/1931 | Le Fever | 137/392 |
| 2,168,409 | A | * | 8/1939 | Johnson | 156/62 |
| 2,219,472 | A | * | 10/1940 | Defandorf et al. | 417/12 |
| 2,949,126 | A | * | 8/1960 | Kuntz et al. | 137/207 |
| 3,721,346 | A | | 3/1973 | Lore et al. | |
| 3,754,288 | A | | 8/1973 | Weiss | |
| 3,974,075 | A | | 8/1976 | Saigh et al. | |
| 4,171,186 | A | * | 10/1979 | Chapman | 417/40 |
| 4,437,811 | A | * | 3/1984 | Iwata et al. | 417/40 |
| 4,540,891 | A | | 9/1985 | Keener et al. | |
| 4,680,437 | A | * | 7/1987 | La Grange et al. | 73/308 |
| 4,909,948 | A | | 3/1990 | Eichelberger, Sr. | |
| 4,917,135 | A | * | 4/1990 | Duncan | 417/40 |
| 5,089,676 | A | * | 2/1992 | Duncan | 417/40 |
| 5,286,349 | A | | 2/1994 | Shurtleff | |
| 5,549,157 | A | * | 8/1996 | Johnson et al. | 417/40 |
| 5,582,680 | A | | 12/1996 | Vankouwenberg et al. | |
| 5,765,995 | A | * | 6/1998 | Springer | 417/40 |
| 6,216,332 | B1 | * | 4/2001 | Jou | 427/348 |
| 6,322,325 | B1 | * | 11/2001 | Belehradek | 417/40 |

OTHER PUBLICATIONS

Barnes–Pumps, Inc., Crane Pumps & Systems, BARNES® Mercury Level Control Wide Angle, Pipe Mounted, 7/93, 5/94 pp. (p. 49, 51 and 52).

Crane, 2000, Crane, Barnes Pressure Systems, 4 pages.*

* cited by examiner

*Primary Examiner*—Charles G. Freay
*Assistant Examiner*—John F Belena
(74) *Attorney, Agent, or Firm*—Adams, Schwartz & Evans, P.A.

(57) ABSTRACT

A level control device is adapted for use in a wastewater pump station. The level control device cooperates with a discharge pump to control the volume of wastewater contained in the pump station. The level control device includes a buoyant housing for being located in the pump station, and capable of floating on a surface of the wastewater. A control switch is adapted for being operatively connected to the motor starter of the discharge pump to activate the pump when the housing reaches a predetermined elevation in the pump station due to an increasing level of wastewater. An anti-accumulation surface of the housing acts to resist accumulation of grease and other waste.

16 Claims, 2 Drawing Sheets

LEVEL CONTROL DEVICE FOR A WASTEWATER COLLECTION BASIN

BACKGROUND OF THE INVENTION

This invention relates broadly to wastewater management, and more specifically to level control devices used in wastewater pump stations. Wastewater is generated from common sources, such as homes, schools, restaurants, hotels, office buildings, and the like. From these sources, wastewater enters a collection system and is gravity fed downstream through underground sewer pipes to a municipal treatment plant where the wastewater is chemically and biologically treated for return to the environment. Collection basins containing one or more wastewater pumps are located in areas of low elevation between the sources of wastewater and the treatment plant.

A pump station is generally constructed of concrete or fiberglass, and is typically between 4 to 12 feet in diameter and can range from 4 to over 40 feet deep. The pump station receives the flow of wastewater from the gravity sewer pipes that feed it. The pump station also houses one or more discharge pumps that serve to "push" the wastewater to another high point, or directly to the treatment plant. Depending on the plant location, multiple pump stations may be required to transport the wastewater to its final destination for treatment.

Each pump station has some means of signaling when the discharge pumps should turn "on" and "off" depending on the level of wastewater in the basin. Most commonly, this signaling means includes four float switches staggered at different elevations in the basin. These floats are wired back to a central control panel that houses the motor starters for the pumps. Depending on which of the floats "tip" determines which of the pump motors energize, when they "deenergize," and when there is a "high water" or "low water" condition.

Wastewater entering these pump stations is composed of many ingredients besides water-the most common being various forms of grease. As wastewater stored in the pump station becomes stagnant, most of this grease rises to the surface and solidifies. This grease tends to collect on, and build-up around, anything it touches. It is particularly common for grease to collect on the aforementioned floats that control the operation of the pumps. When grease collects on a float, it generally weighs the float down. It commonly restricts the operation of the electrical switch which controls automatic operation of the pump by not allowing the float to "tip". In this case, the pump motor can not activate to transfer the rising wastewater from the pump station further downstream towards the treatment plant. As a result, the station goes into an "alarm" state, and can overflow onto the ground around it, and into a nearby creek or stream. In other instances, grease will "bridge" from a float to a pipe or other structure in the pump station, and the float will "stick" in the "up" position. When this happens, the pump motor never gets its signal to turn off, and continues to run even after there is no wastewater remaining in the basin. In this event, the motor overheats causing substantial and costly mechanical damage to the pump.

The present invention addresses these concerns by replacing the traditional buoyant float with a buoyant float having an anti-accumulation surface that will resist the accumulation of grease and other waste. In one embodiment of the invention, the surface of the float is heated using an electric current. Alternatively, the surface of the float may be coated with an anti-friction material, such as Teflon.

BRIEF SUMMARY OF THE INVENTION

Therefore, it is an object of the invention to provide a level control device for a wastewater pump station which cooperates with the discharge pump(s) to manage the volume of wastewater contained in the basin.

It is another object of the invention to provide a level control device which includes a buoyant housing that resists accumulation of grease and waste.

It is another object of the invention to provide a level control device which operates properly over an extended period of usage with little maintenance and cleaning.

These and other objects of the present invention are achieved in the preferred embodiments disclosed below by providing a level control device adapted for use in a wastewater pump station. The level control device cooperates with a discharge pump to control the volume of wastewater contained in the basin. The level control device includes a buoyant housing for being located in the basin, and capable of floating on a surface of the wastewater. Anti-accumulation means acts to resist accumulation of grease and other waste on the surface of the housing.

According to another preferred embodiment of the invention, the buoyant housing has a conductive surface for receiving and transmitting heat to the immediate surrounding area. This anti-accumulation means includes a heating element connected to the housing to heat the conductive surface such that grease, and other waste contained in the basin, resists adhering to the heated surface.

According to another preferred embodiment of the invention, the heating element includes an electrode designed to carry an electric current from an electrical source to the conductive surface of the housing.

According to another preferred embodiment of the invention, the electrode is a copper wire.

According to another preferred embodiment of the invention, the conductive surface of the housing is stainless steel.

According to another preferred embodiment of the invention, a power cable is attached to the housing and may include a plug for being inserted into an electric outlet.

According to another preferred embodiment of the invention, a weight is secured to the power cable to suspend the float at the desired elevation.

According to another preferred embodiment of the invention, the control switch includes a mercury control switch or a mechanical switch contained in the housing.

In another embodiment, the invention is a method for controlling the volume of wastewater contained in a wastewater pump station. The method includes the steps of employing a discharge pump for removing wastewater from the basin. A buoyant float switch is positioned in the basin, and capable of floating on a surface of the wastewater. Anti-accumulation means are provided for resisting accumulation of grease and other waste on the surface of the housing. The float is wired through the pump control panel, which is wired to the discharge pump, to activate the pump when the float "tips" at a predetermined elevation in the basin triggered by the increasing level of wastewater.

BRIEF DESCRIPTION OF THE SEVERAL VIEWS OF THE DRAWINGS

Some of the objects of the invention have been set forth above. Other objects and advantages of the invention will appear as the description proceeds when taken in conjunction with the following drawings, in which.

DETAILED DESCRIPTION OF THE INVENTION

Figure 1:
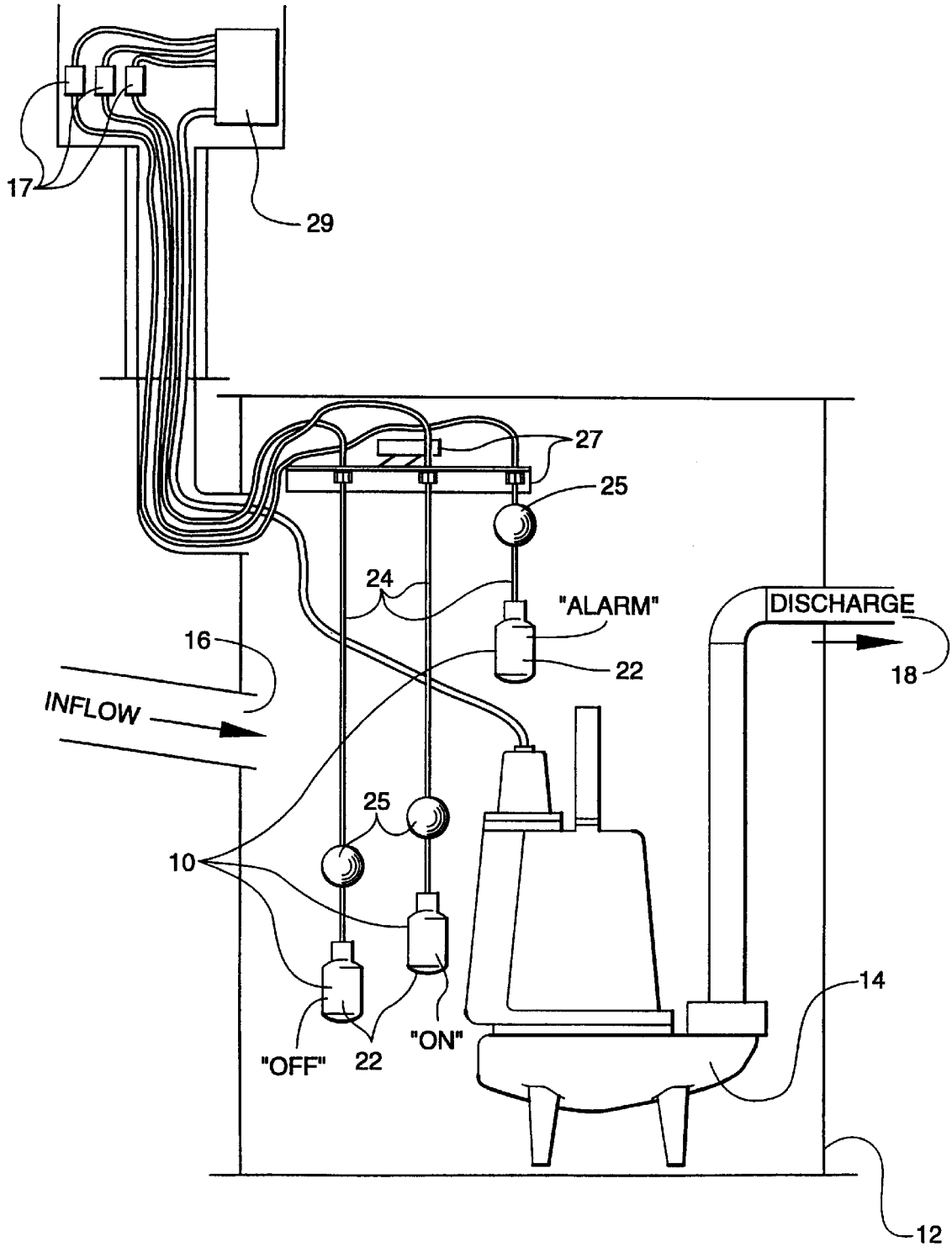
FIG. 1 is an environmental, side elevational view of a wastewater pump station with a discharge pump and a level control device according to one preferred embodiment of the invention.

Referring now specifically to the drawings, a level control device according to the present invention is illustrated in FIG. 1 and shown generally at reference numeral 10. The level control device 10 is especially applicable for use in a wastewater pump station 12. In a preferred system, the pump station 12 includes a plurality of devices 10 which cooperate with a discharge pump 14 to control the volume of wastewater contained in the pump station 12. Wastewater enters the pump station 12 through an inlet 16, and is subsequently discharged through a pump discharge pipe 18 when the station 12 reaches a predetermined maximum level. From the pump station 12, the wastewater is moved downstream to a municipal treatment plant where the wastewater is chemically and biologically treated for return to the environment.

As shown in FIG. 1, the level control device 10 includes a buoyant housing 22 containing a single point, omnidirectional mercury capsule switch, such as described in U.S. Pat. No. 4,540,891. The complete disclosure of this patent is incorporated herein by reference. The buoyant housing 22 is positioned at the desired elevation by the lead weight 25 connected to the insulated power cable 24. The power cable 24 supports the weight and float, and is supported itself by a stainless steel float mounting bracket 27. The insulated float cables 24 carry the "closed" or "open" signals to a series of control relays 17 that signals the motor starter 29 to energize or de-energize. As the level of wastewater in the station 12 rises, the mercury switch becomes oriented in a position where the mercury provides a connection between contacts of the switch. The closed contacts then provide a signal through the relays 17 to the motor starter 29, which supplies current to the pump motor causing wastewater to be pumped outwardly from the station 12 through the discharge pipe 18 and downstream towards the treatment plant. As the fluid level drops down, the mercury switch contacts of the "off" float open, interrupting the circuit to the motor and stopping operation of the pump 14.

Figure 2:
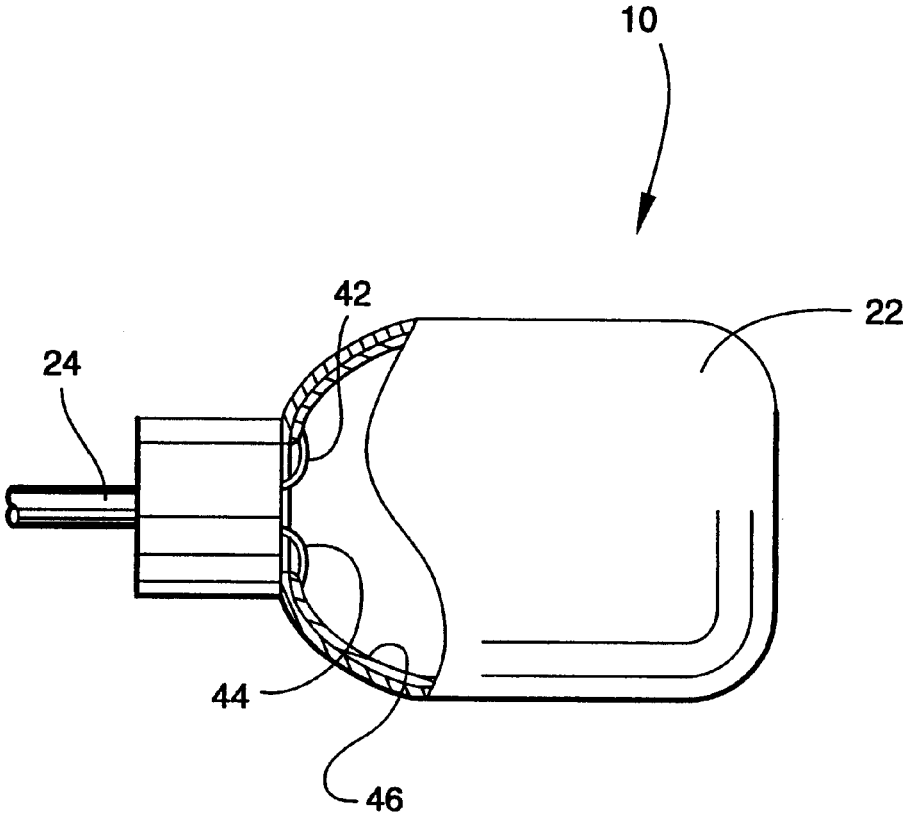
FIG. 2 is view of level control device with a portion of the housing wall broken away to expose the interior cavity of the housing.

In a preferred embodiment shown in FIG. 2, the level control device 10 includes a heating element which operates through heat conduction to maintain the exterior surface of the buoyant housing 22 at a temperature of between about 80 to 110 degrees Fahrenheit. The heating element includes copper wire electrodes 42 and 44 which extend into the cavity of the housing 22 and carry electric current from the power source through the cable 24 to a coated interior surface 46. The interior surface 46 is preferably coated with a thermally stable, synthetic resin including dispersed conductive particles, such as carbon black aggregated particles. The resistence measured between the electrodes 42 and 44 may be adjusted in order to maintain the desired temperature range. The exterior surface of the housing 22 is preferably formed of stainless steel. As a result of its heated exterior, the housing 22 resists an accumulation of grease and other waste which might otherwise affect proper operation of the device 10, and activation and deactivation of the discharge pump 14.

In an alternative embodiment, the exterior surface of the housing 22 is formed of Teflon or other anti-friction material sufficient to resist the accumulation of grease and other waste. The anti-friction surface may be heated, as described above, or not.

A fluid level control device for an underground wastewater pump station is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

What is claimed is:

1. A level control device adapted for use in a wastewater pump station and cooperating with a discharge pump to control the volume of wastewater contained in the pump station, said level control device comprising:

a buoyant housing for being located in the pump station, and capable of floating on a surface of the wastewater, said buoyant housing comprising a conductive surface for receiving and transmitting heat to a surrounding area;

a control switch for being operatively connected to the discharge pump to activate the pump when said housing reaches a predetermined elevation in the pump station due to an increasing level of wastewater; and a heating element connected to said housing to heat the conductive surface such that grease and other waste contained in the pump station resist adhering to said housing.

2. A level control device according to claim 1, wherein said heating element comprises an electrode designed to carry an electric current from an electrical source to the conductive surface of said housing.

3. A level control device according to claim 1, wherein the conductive surface of said housing comprises stainless steel.

4. A level control device according to claim 1, and comprising a float cable attached to said housing, and extending to an electrical source supplying energy to said control switch.

5. A level control device according to claim 4, and comprising a weight secured to said float cable for positioning said buoyant housing at a desired elevation in the pump station.

6. A level control device according to claim 1, wherein said control switch comprises a mercury control switch contained in said housing.

7. A level control device according to claim 1, wherein said control switch comprises a mechanical switch contained in said housing.

8. A level control assembly for use in a wastewater pump station to control the volume of wastewater contained in the pump station, said level control assembly comprising:

a discharge pump for removing wastewater from the pump station;

a buoyant housing for being located in the pump station, and capable of floating on a surface of the wastewater, said buoyant housing comprising a conductive surface for receiving and transmitting heat to a surrounding area;

a control switch operatively connected to said discharge pump to activate said pump when said housing reaches a predetermined elevation in the pump station due to an increasing level of wastewater; and a heating element connected to said housing to heat the conductive surface such that grease and other waste contained in the pump station resist adhering to said housing.

9. A level control assembly according to claim 8, wherein said heating element comprises an electrode designed to carry current from an electric source to the conductive surface of said housing.

10. A level control assembly according to claim 11, wherein said electrode comprises a copper wire.

11. A level control assembly according to claim 8, wherein the conductive surface of said housing comprises stainless steel.

12. A level control assembly according to claim 8, and comprising a float cable attached to said housing, and extending to an electrical source supplying energy to said control switch.

13. A level control assembly according to claim 12, and a weight secured to said float cable for positioning said buoyant housing at a desired elevation in the pump station.

14. A level control assembly according to claim 8, wherein said control switch comprises a mercury control switch.

15. A level control assembly according to claim 8, wherein said control switch comprises a mechanical switch.

16. A method for controlling the volume of wastewater contained in a wastewater pump station, said method comprising the steps of:

employing a discharge pump for removing wastewater from the pump station;

positioning a buoyant housing in the pump station, the housing being capable of floating on a surface of the wastewater, the buoyant housing comprising a conductive surface for receiving and transmitting heat to a surrounding area;

heating the conductive surface of the buoyant housing such that grease and other waste contained in the pump station resist adhering to the housing; and operatively connecting a control switch the discharge pump to activate the pump when the housing reaches a predetermined elevation in the pump station due to an increasing level of wastewater.

* * * * *

UNITED STATES PATENT AND TRADEMARK OFFICE

CERTIFICATE OF CORRECTION

PATENT NO. : 6,464,465 B2
DATED : October 15, 2002
INVENTOR(S) : Glenn P. House

It is certified that error appears in the above-identified patent and that said Letters Patent is hereby corrected as shown below:

Column 5,
Line 5, delete “claim 11” and insert -- claim 9 --.

Column 6,
Line 16, after “switch” insert -- to --.

Signed and Sealed this

Ninth Day of December, 2003

JAMES E. ROGAN
*Director of the United States Patent and Trademark Office*